US008052448B2

(12) United States Patent
McKee

(10) Patent No.: US 8,052,448 B2
(45) Date of Patent: Nov. 8, 2011

(54) CARD EDGE CONNECTOR

(75) Inventor: Michael McKee, Camp Hill, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 137 days.

(21) Appl. No.: 12/647,410

(22) Filed: Dec. 25, 2009

(65) Prior Publication Data

US 2011/0159718 A1 Jun. 30, 2011

(51) Int. Cl.
*H01R 13/62* (2006.01)

(52) U.S. Cl. ..... 439/326

(58) Field of Classification Search ..... 439/326, 439/160, 157, 159, 152, 153, 372, 680
See application file for complete search history.

(56) References Cited

U.S. PATENT DOCUMENTS 6,132,228 A * 10/2000 Lang ..... 439/160
6,428,360 B2 * 8/2002 Hassanzadeh et al. ..... 439/633
6,431,889 B1 * 8/2002 Olson ..... 439/157
6,520,805 B2 * 2/2003 Hassanzadeh et al. ..... 439/633
7,029,307 B1 * 4/2006 Ling et al. ..... 439/327
7,118,398 B2 10/2006 Leidy

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A card edge connector assembly having: a memory module having a first side portion, an opposite second side portion, and a plurality of conductive pads on a lower portion thereof, the lower portion extending from the first side portion to the second side portion; a card edge connector having an insulative housing having a first end, an opposite second end and a central slot extending from the first end to the second end to receive the lower portion of the memory module; and means identifying the corresponding memory module to be inserted into the central slot, comprising a key notch being defined at the second side portion of the memory module, and an arc pivot extending from the second end to engage with the key notch to guide the memory module to be rotated into the central slot along an anticlockwise direction.

18 Claims, 10 Drawing Sheets

CARD EDGE CONNECTOR

BACKGROUND OF THE INVENTION

1. Field of the Invention

The present invention generally relates to a card edge connector for receiving a memory module and more particularly to a card edge connector including means to reduce insertion force of the memory module.

2. Description of Related Art

A card edge connector is used to hold a memory module such as a DDR 3 module and to electrically couple such module to a mother printed circuit board on which the card edge connector is mounted. With the high speed development of the memory module, more and more golden pads are added to the module, correspondingly, the number of terminals of the card edge connector is increased, thereby making it difficult to insert the module into the card edge connector via a linear movement of the module along an up-to-down direction. In order to solve this problem, users are advised to insert one end of the module into a pivot end of the card edge connector firstly, and then rotate the other end of the module downwardly and plug the other end of the module into the other end of the card edge connector, an ejector on the other end of the card edge connector lock with the module finally. However, the ejector may happen to disengage from the module under an accidental vibration, and the module may escape from the card edge connector unexpectedly; besides, the module is easily disengaged from the pivot end when another end of the module is free and not limited by the insulative housing in the rotation process.

The memory module generally includes a key notch on a bottom edge thereof to engage with a key in a central slot of the card edge connector and a pair of locking notches on opposite side edges thereof, one of the locking notches mate with the pivot end, the other one of the locking notches lock with the ejector, that is to say, the memory module is formed with at least three notches, such as DDR2 and DDR3. The key notch on the bottom edge of the memory module engages with the key in the central slot of the card edge connector to ensure the memory module be received in the central slot in a correct way and prevent an unmatched memory module from being inserted in the central slot by a mistake. However, the key notch on the bottom edge holds a space which increases a length of the memory module and increases friction between the memory module and the card edge connector, thereby making it difficult to insert the module into the card edge connector.

Hence, an improved card edge connector is desired to overcome the above problems.

SUMMARY OF THE INVENTION

According to one aspect of the present invention, a card edge connector assembly comprises: a memory module comprising a first side portion, an opposite second side portion, and a plurality of conductive pads on a lower portion thereof, the lower portion extending from the first side portion to the second side portion; a card edge connector comprising an insulative housing having a first end, an opposite second end and a central slot extending from the first end to the second end to receive the lower portion of the memory module, and a plurality of contacts retained to the insulative housing to contact with the conductive pads; and means identifying the corresponding memory module to be inserted into the central slot, comprising a key notch being defined at the second side portion of the memory module, and an arc pivot extending from the second end to engage with the key notch to guide the memory module to be rotated into the central slot along an anticlockwise direction, the key notch defining a first semidiameter, the arc pivot defining a second semidiameter which is not larger than the first semidiameter for preventing an incorrect module from being plugged into the socket.

According to another aspect of the present invention, a card edge connector for mating with a corresponding memory module with a notch at a side thereof, comprises: an insulative housing having a first end and an opposite second end and a central slot extending from the first end to the second end, the first end having a first cavity for receiving one side of the memory module, the second end having a second cavity for receiving another side of the memory module and a pivot extending into the second cavity to engage with the notch for guiding the memory module being plugged into the central slot along an anticlockwise direction; and a plurality of contacts retained in the insulative housing, each contact having a contact portion extending into the central slot; wherein the first end has a spring tab with a resistible portion at an upper side thereof to resist the memory module against the pivot.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
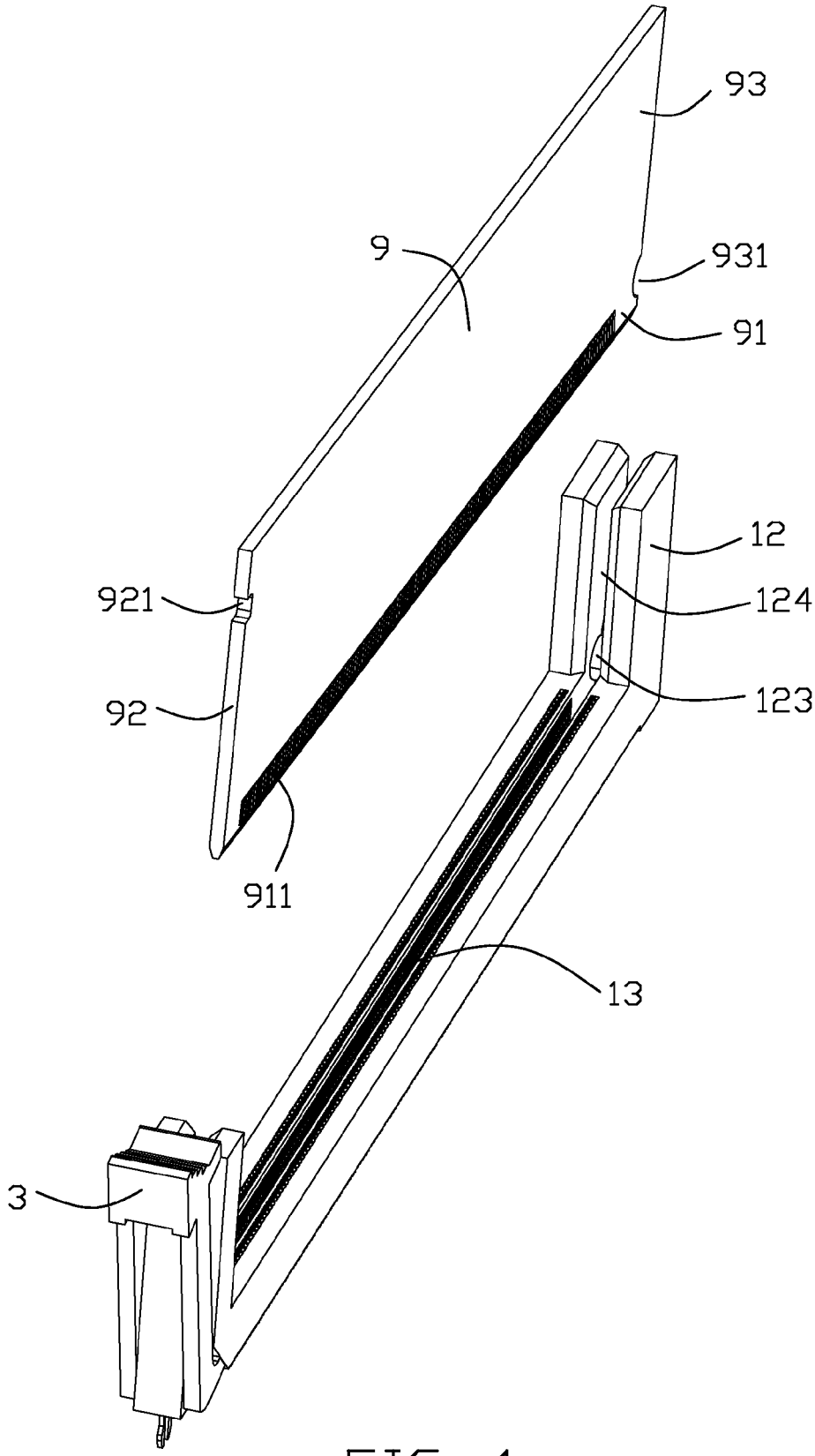
FIG. 1 is a perspective view of a card edge connector and a corresponding memory module according to the present invention.
Figure 2:
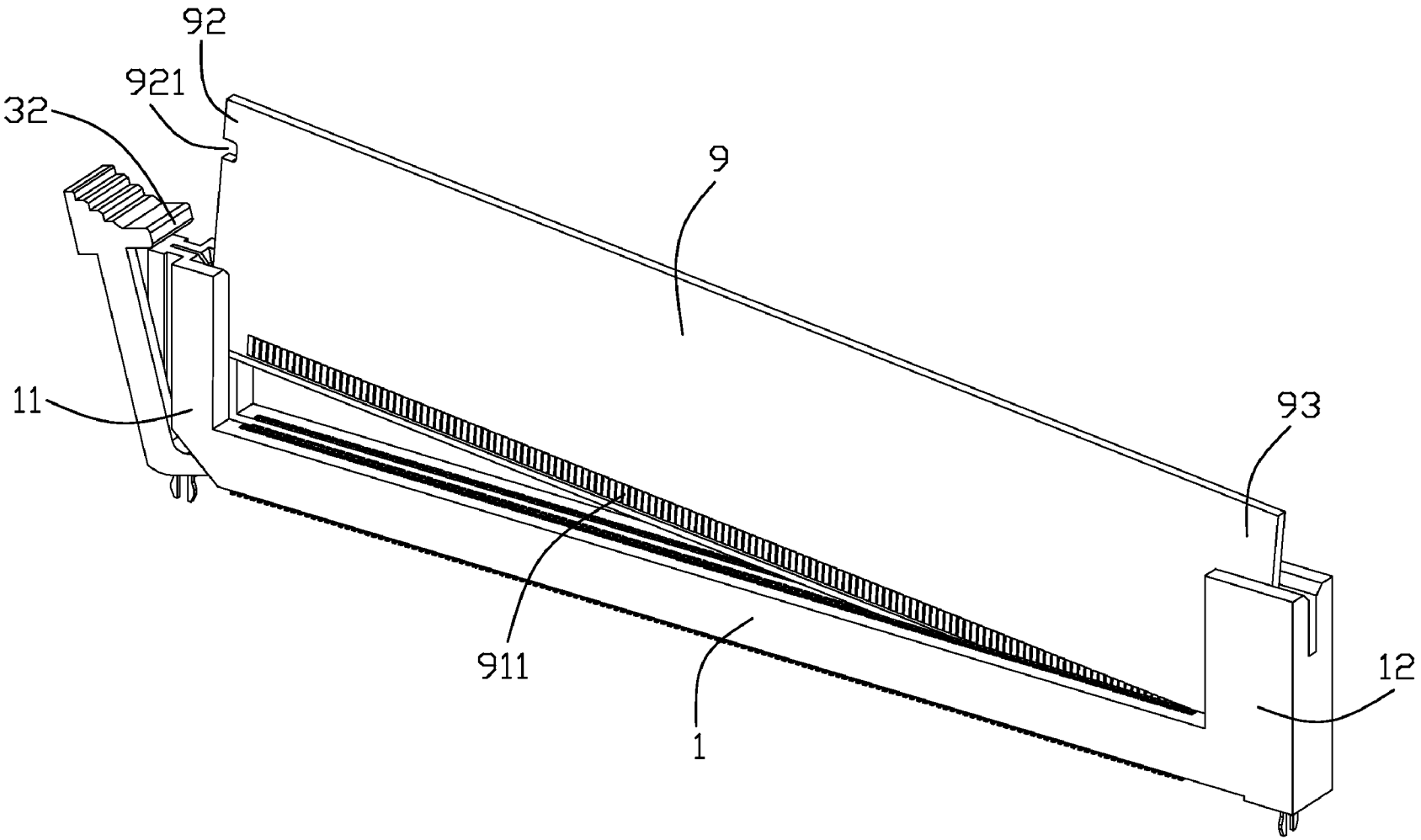
FIG. 2 is a perspective view of a card edge connector with the memory module being inserted therein.
Figure 3:
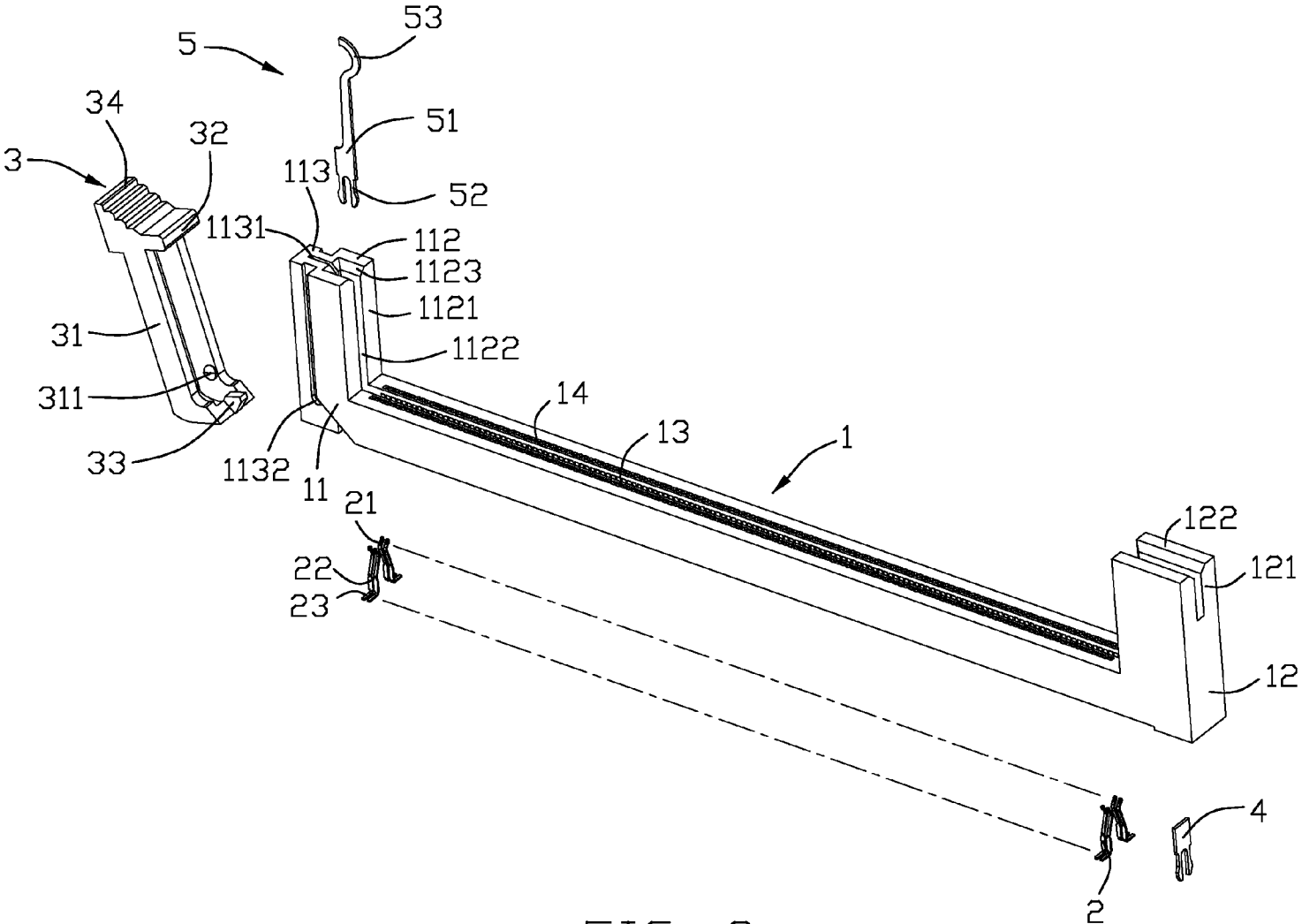
FIG. 3 is an exploded view of the card edge connector.
Figure 4:
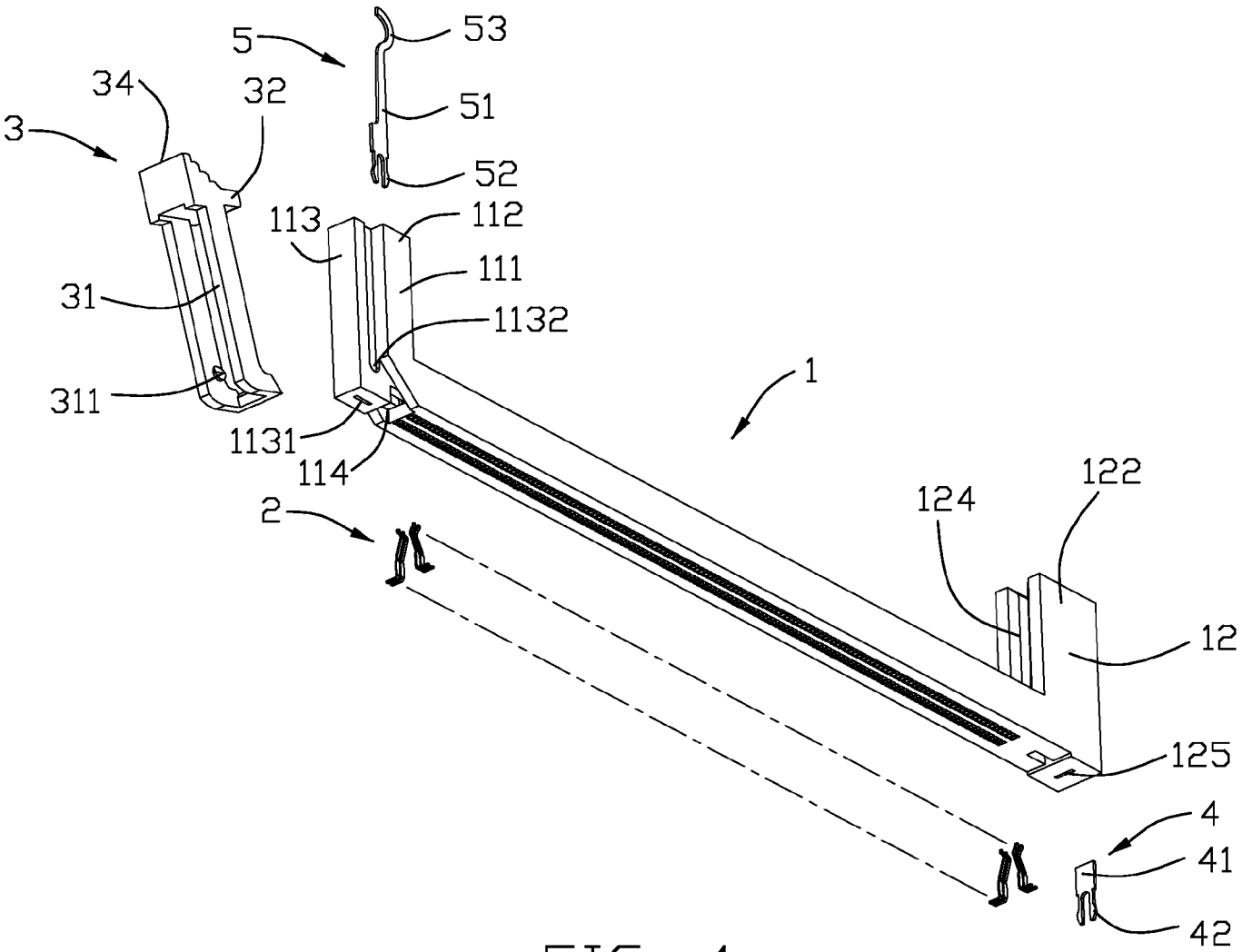
FIG. 4 is a view similar to FIG. 3, while taken from a different aspect.

Reference will be made to the drawing figures to describe the present invention in detail, wherein depicted elements are not necessarily shown to scale and wherein like or similar elements are designated by same or similar reference numeral through the several views and same or similar terminology.

Figure 5:
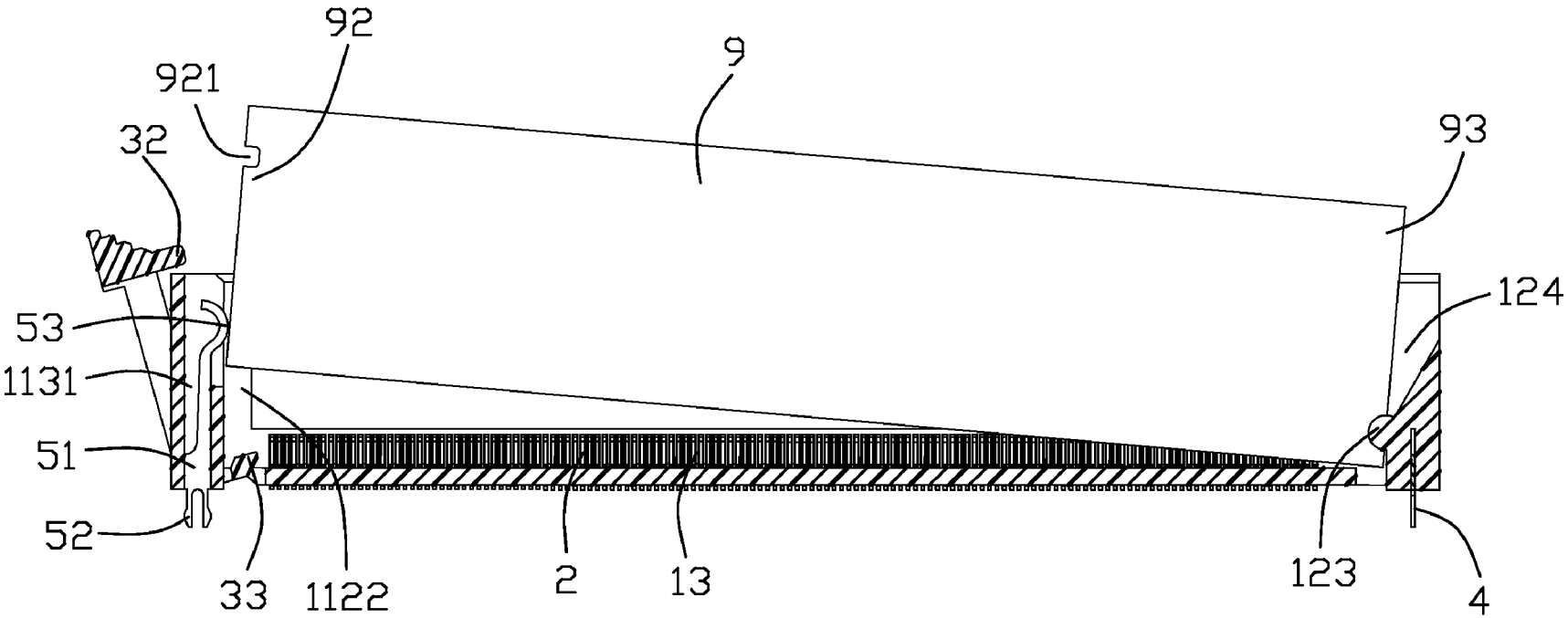
FIG. 5 is a cross-sectional view of the FIG. 2.
Figure 6:
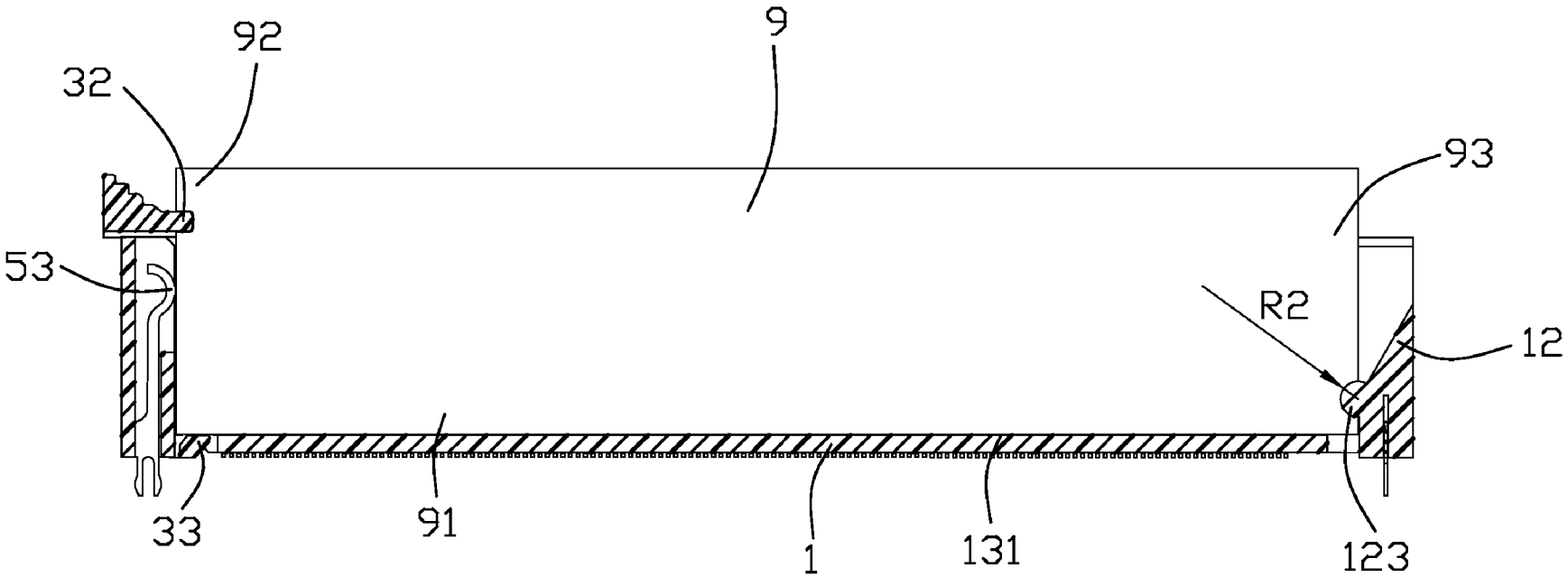
FIG. 6 is a cross-sectional view of the card edge connector with the memory module fully inserted therein.
Figure 7:
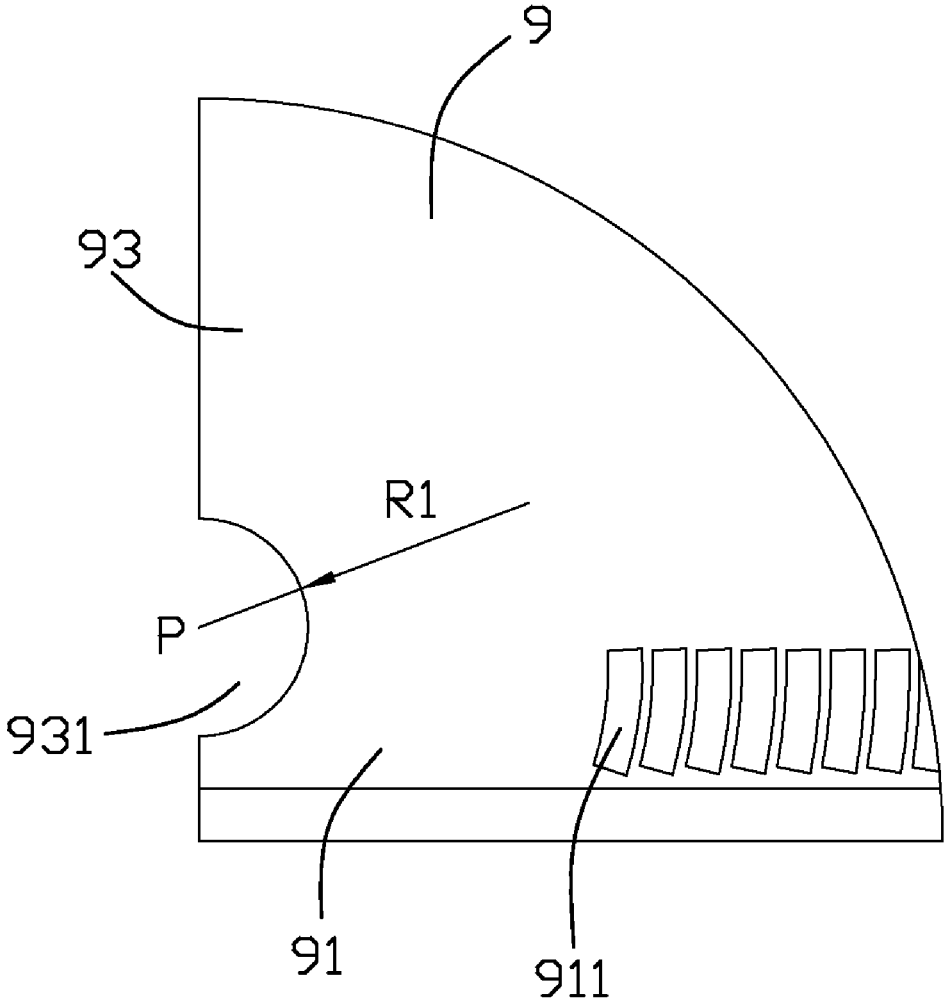
FIG. 7 is a partly front elevational view of the memory module shown in FIG. 1.

Referring to FIGS. 1-7, a card edge connector 100 for connecting with a memory module 900 according to the present invention is disclosed. The card edge connector 100 comprises an elongate insulative housing 1, a plurality of contacts 2 retained in the insulative housing 1, an ejector 3 rotatably retained on one end of the insulative housing 1, a board lock 4 retained on the insulative housing 1 and a spring tab 5 retained on the end of the insulative housing 1. The memory module 9 has a plurality of conductive pads 911 at a lower portion 91 thereof, a first side portion 92 with a cutout 921 defined at an upper side thereof, and an opposite second side portion 93 with a key notch 931 defined at a lower side thereof. The lower portion 91 extends continuously from the first side portion 92 to the second side portion 93 and does not have any notch thereon. The cutout 921 is offset to the key notch 931 along an up to down direction. The key notch 931 defines a first semidiameter R1 and a pivot point P locating in a line with a first side portion 92 of the memory module 9. Referring to FIG. 7, a partial conductive pads 911 are curved to assure a large contact area between the conductive pads 911 and the contacts 2 of the card edge connector 100 during mating.

Referring to FIGS. 1-4, the insulative housing 1 includes a first end 11, an opposite second end 12, a central slot 13 extending from the first end 11 to the second end 12 to receive the lower portion 91 of the memory module 9, and a plurality of passageways 14 extending therethrough along the up to down direction and communicating with the central slot 13. Each contact 2 has a securing portion 22 retained in the passageways 14, a contact portion 21 extending into the central slot 13 to electrically connect with the conductive pads 911 on the memory module 9, and a tail portion 23 extending horizontally out of the insulative housing 1 to be surface mounted to a circuit board (not shown). The central slot 13 is penetrating from the first end 11 to the second end 12 and does not have any key therein.

The first end 11 includes a first tower 111 extending upwardly therefrom and the ejector 3 pivotally assembled to the first tower 111. The first tower portion 111 has an inner section 112 and an outer section 113 which is narrower than the inner section 112 along a width direction of the insulative housing 1. The inner section 112 has a pair of first side walls 1121 and a first cavity 1122 between the first side walls 1121. The first cavity 1122 communicates with the central slot 13 along a length direction of the insulative housing 1 and opens to exterior at a top end thereof to receive the first side portion 92. Each first side wall 1121 has a guiding face 1123 at a top end thereof for guiding the memory module 9 to be inserted into the first cavity 1122. The outer section 113 defines a slit 1131 extending therethrough along the up to down direction to receive the spring tab 5 and a pair of slots 1132 at two sides thereof. The slit 1131 communicates with the first cavity 1122 along the length direction. The first end 11 defines a groove 114 at a bottom side thereof. The groove 114 communicates with the first cavity 1122 along the up to down direction.

The second end 12 has a second tower 121 extending upwardly therefrom. The second tower 121 is integrally formed with a pair of second side walls 122 and an arc pivot 123 between the second side walls 122. A second cavity 124 is defined between the side walls 122 to receive the second side portion 93. The arc pivot 123 connects with the second side walls 122 at two sides and a rear side thereof, and is exposed to the second cavity 124 at upper, lower and front sides thereof. The key notch 931 is configured corresponding to the arc pivot 123. The arc pivot 123 mates with the key notch 931 to guide the memory module 9 to be rotated into the central slot 13 along an anticlockwise direction, and defines a second semidiameter R2 which is not larger than the first semidiameter R1, thereby the key notch 931 and the arc pivot 123 constitute a means which can identify a correct memory module, like the memory module 9 in the present invention, to be inserted into the central slot 13 accurately, and prevent an incorrect memory module having a notch with a semidiameter which is smaller than the second semidiameter R2 from being inserted in the central slot 13. Besides, the second end 12 defines a slot 125 recessed from a bottom side thereof to retain the board lock 4. The board lock 4 has a retaining portion 41 fixed in the slot 125 and a pair of legs 42 extending out of the insulative housing 1 to lock with the circuit board.

The ejector 3 is pivotally retained on the first tower 11 and includes a pair of opposed side walls 31 at a middle portion thereof, an ejecting portion 33 extending inwardly into a lower side of the first cavity 1122 from the groove 114 thereof, a locking portion 32 extending inwardly from an upper side thereof, and an operating portion 34 extending outwardly from the upper side thereof. The side walls 31 are located at two sides of the outer section 113 of the first tower 11 and each has a projecting axes 311 at a lower side thereof to engage with the slots 1132. The projecting axes 311 can rotate in the slots 1132 to guide the ejector 3 rotating along the clockwise direction. The locking portion 32 is rotated to an upper position of the first tower 11 to lock with the cutout 921 of the first side portion 92 when the memory module 9 is completely plugged into the central slot 13.

The spring tab 5 extends along the up to down direction and includes a body portion 51 retained in the slit 1131, a board lock 52 extending downwardly out of the insulative housing 1 for retaining the card edge connector 100 to the circuit board, and a resistible portion 53 at an upper side thereof. The resistible portion 53 presents as an arc shape extending upwardly and inwardly from the body portion 51. The resistible portion 53 extends into the first cavity 1122 to push the first side portion 92 for making the key notch 921 engage with the arc pivot 123 closely.

Referring to FIG. 5, when the memory module 9 is to be inserted into the central slot 13 of the insulative housing 1, the second side portion 93 is inserted into the second cavity 124 firstly, and the key notch 931 of the memory module 9 engages with the arc pivot 123 of the insulative housing 1. Then the memory module 9 is pressed to move anticlockwisely toward the insulative housing 1 until a lower end of the first side portion 92 thereof reaches a bottom face 131 of the central slot 13 of the insulative housing 1. In the rotation process of the memory module 9, the resistible portion 53 of the spring tab 5 resist the memory module 9 against the arc pivot 123 to help prevent any misalignment and disengagement from the arc pivot 123. Referring to FIG. 6, the ejector 3 is inwardly rotated until the locking portion 32 locks with the cutout 921 of the first side portion 92. In such situation, the lower portion 91 of the memory module 9 is fully received in the central slot 13 of the insulative housing 1, and the contact portions 21 electrically connect with the conductive pads 911 to transmit signals.

When extract the memory module 9 from the card edge connector 100, the ejector 3 is rotated outwardly in such a way that the ejecting portion 33 thereof lifts up the first side portion 92 of the memory module 9 firstly. The memory module 9 is then rotated clockwisely around the arc pivot 123 of the second end 12 on the insulative housing 1 until the memory module 9 is completely moved out of the card edge connector 100.

As described above, when the memory module 9 is inserted into or withdrawn from the card edge connector 100, the memory module 9 is pivoted about the arc pivot 123 on the stationary second tower 121 in such a way that the conductive pads 911 on the second side portion 93 contact with corresponding contacts 2 in the second end 12 earlier than the conductive pads 911 on the first side portion 92, and the first side portion 92 extends into the central slot 13 later than the second side portion 93. Thus, the memory module 9 acts as a lever, and a total force needed to insert the memory module 9 is significantly reduced as much as 50% due to the sequential engagement of the conductive pads 911 and the contacts 2. Besides, when the number of contacts 2 increases, and the center to center distances between the contacts 2 decrease, the manufacturing tolerances of the memory module 9 and the card edge connector 100 are forced to decrease. Then the spring tab 5 in the present invention can reduce the tolerance accumulation and help preventing any misalignment as the memory module 9 is being plugged by forcing the memory module 9 against the arc pivot 123.

Figure 8:
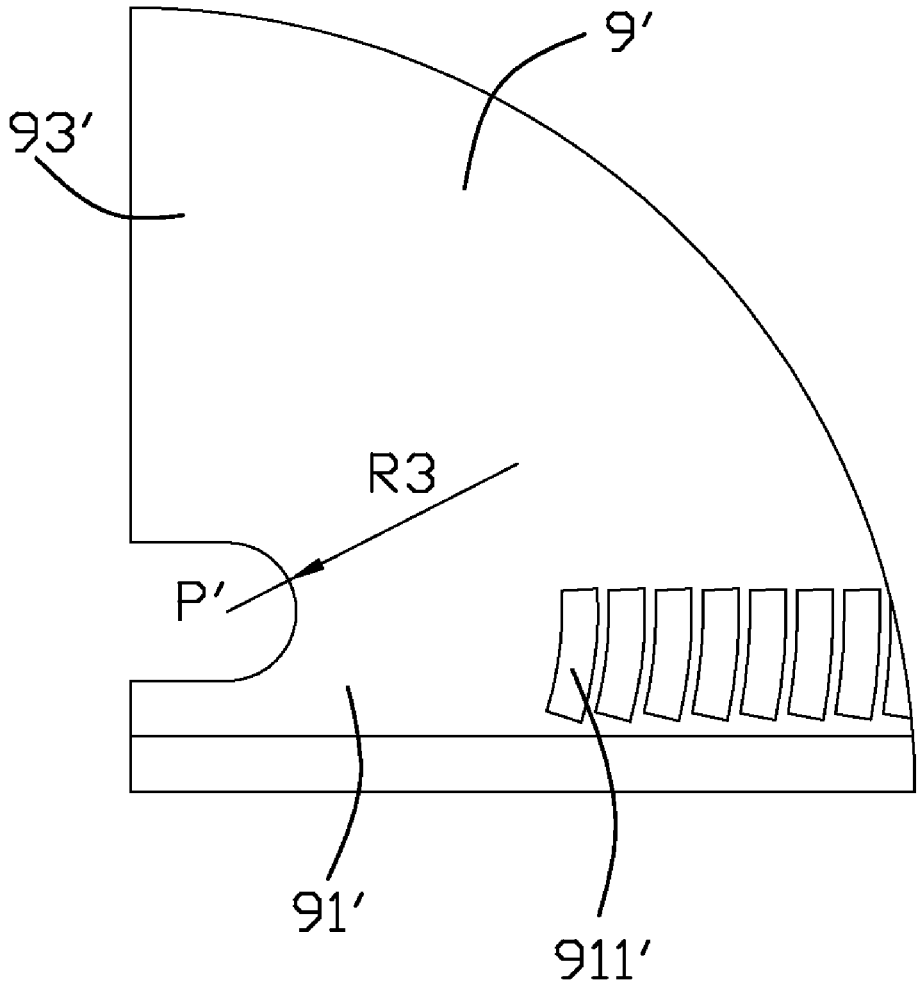
FIG. 8 is a partly front elevational view of an unmatched memory module which can not mate with the card edge connector of the present invention.
Figure 9:
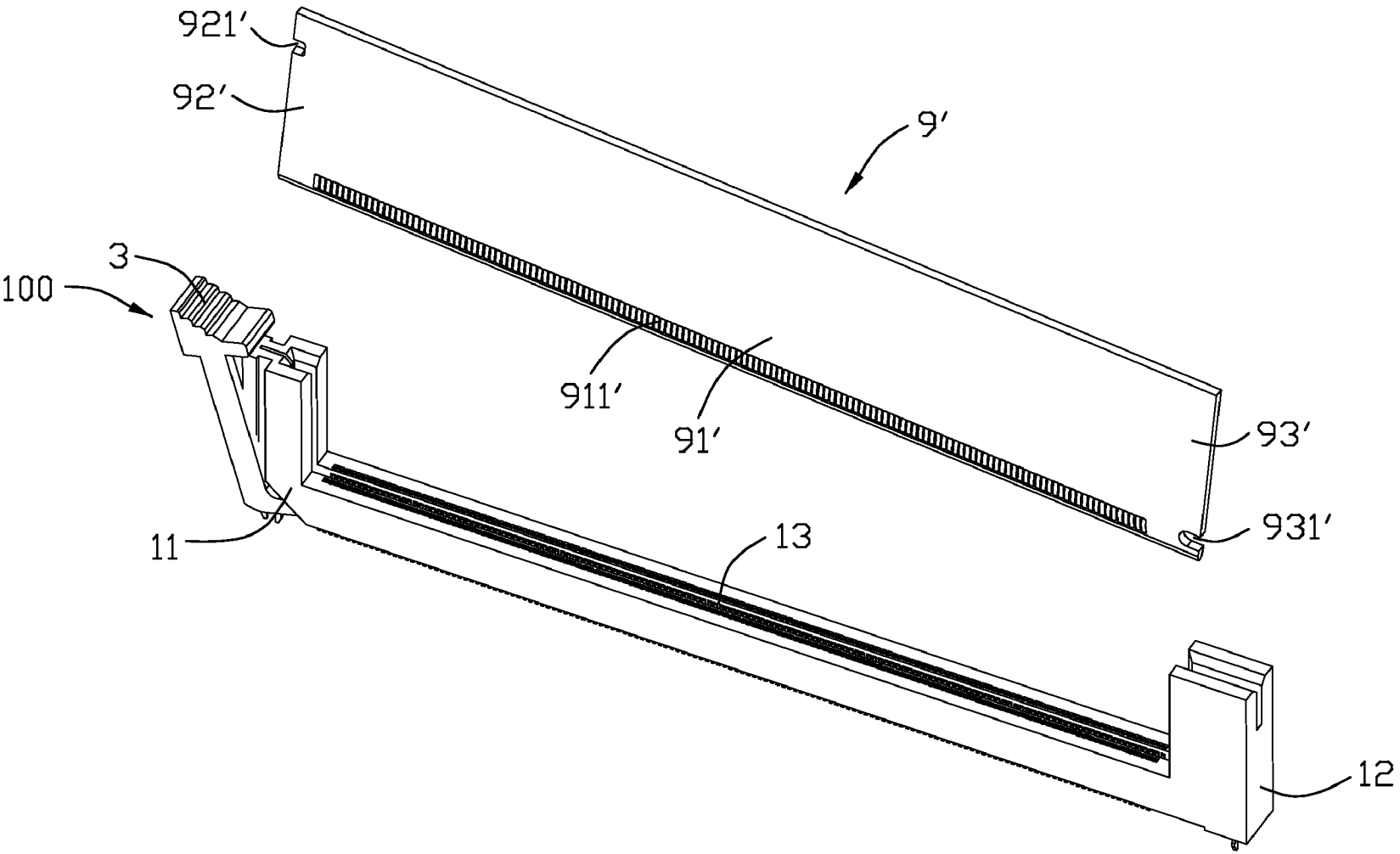
FIG. 9 is a perspective view of the card edge connector and the unmatched memory module shown in FIG. 8.
Figure 10:
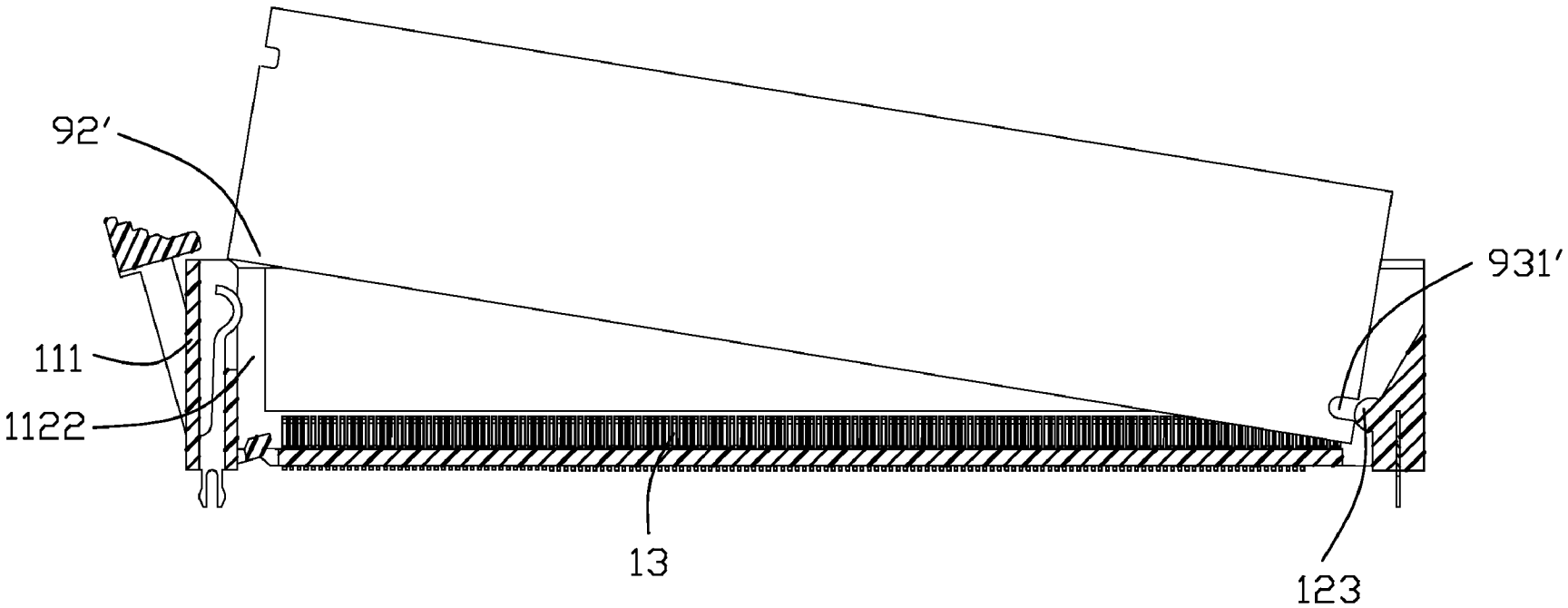
FIG. 10 is a cross-sectional view of the card edge connector with the unmatched memory module being inserted therein.

Referring to FIGS. 8-10, an unmatched memory module 9' shown therein also includes a lower portion 91' with a plurality of conductive pads 911', a first side portion 92' with a cutout 921' and an opposed second side portion 93' with a notch 931'. The notch 931' presents as a U shape and defines a pivot point P' which is located at an inner side of the first side portion 92' along a length direction thereof. The notch 931' defines a third semidiameter R3 which is smaller than the first and second semidiameter R1, R2. Therefore, referring to FIG. 10, when the unmatched memory module 9' is intended to be inserted into the card edge connector 100, the notch 931' is too smaller to mate with the arc pivot 123 of the card edge connector 100. Then a lower side of the first side portion 92' collides with a front end of the first tower 111 and can not be inserted into the first cavity 1122.

Therefore, the arc pivot 123 of the card edge connector 100 in the present invention defines the special second semidiameter R2 which can just mate with the key notch 931 with the first semidiameter R1. In such a way that the arc pivot 123 on the card edge connector 100 and the key notch 931 of the memory module 9 in the present invention constitute a means which can identify a correct connection between the card edge connector 100 and the correct memory module 9, and prevent an incorrect or unmatched memory module 9' from being plugged into the card edge connector 100. In addition, it is unnecessary to provide a key in the central slot 13 and a slot on the lower portion 91 corresponding to the key for prevent an incorrect connection between the memory module 9 and the card edge connector 100, such as DDR2 and DDR3. The memory module 9 and the card edge connector 100 in the present invention have simple structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card edge connector assembly, comprising:

a memory module comprising a first side portion, an opposite second side portion, and a plurality of conductive pads on a lower portion thereof, the lower portion extending from the first side portion to the second side portion;

a card edge connector comprising an insulative housing having a first end, an opposite second end and a central slot extending from the first end to the second end to receive the lower portion of the memory module, and a plurality of contacts retained to the insulative housing to contact with the conductive pads; and means identifying the corresponding memory module to be inserted into the central slot, comprising a key notch being defined at the second side portion of the memory module, and an arc pivot extending from the second end to engage with the key notch to guide the memory module to be rotated into the central slot along an anticlockwise direction, the key notch defining a first semidiameter, the arc pivot defining a second semidiameter which is not larger than the first semidiameter for preventing an incorrect module from being plugged into the connector.

2. The card edge connector assembly as claimed in claim 1, wherein the key notch is configured corresponding to the arc pivot and defines a pivot point locating at a line with the second side portion of the memory module.

3. The card edge connector assembly as claimed in claim 1, wherein the second end has a second tower extending upwardly therefrom and having a pair of second side walls at two sides of the arc pivot, the second tower defines a second cavity between the side walls to receive the second side portion, the arc pivot connects with the second side walls at two sides and a rear side thereof, and is exposed to the second cavity at upper and lower sides thereof.

4. The card edge connector assembly as claimed in claim 1, further comprising a spring tab at the first end, the spring tab has a resistible portion at an upper side thereof to push the memory module against the arc pivot.

5. The card edge connector assembly as claimed in claim 4, wherein the spring tab extends along an up to down direction, and has a body portion retained in the first end and a board lock extending out of the insulative housing for positioning the card edge connector to a circuit board, the resistible portion presents as an arc shape extending upwardly and inwardly from the body portion.

6. The card edge connector assembly as claimed in claim 5, wherein the first end comprises a first tower extending upwardly therefrom, the first tower defines a slit extending therethrough along an up to down direction to receive a spring tab.

7. The card edge connector assembly as claimed in claim 6, wherein the first tower has an inner section and an outer section which is narrower than the inner section along a width direction of the insulative housing, the inner section defines a first cavity communicating with the central slot along a length direction of the insultive housing and opening to exterior at a top end thereof to receive the first side portion.

8. The card edge connector assembly as claimed in claim 7, wherein the slit is formed in the outer section and communicates with the first cavity along the length direction, the resistible portion extends into the first cavity from the silt.

9. The card edge connector assembly as claimed in claim 7, further comprising an ejector pivotally assembled to the first tower, the ejector has a pair of opposed side walls located at two sides of the outer section, the outer section defines a pair of slots at two sides thereof, the side walls of the ejector each has a projecting axes to engage with the slots for guiding the ejector moving along a clockwise direction.

10. The card edge connector assembly as claimed in claim 9, wherein the ejector has an ejecting portion at a lower side thereof, and a locking portion extending inwardly from an upper side thereof, the first side portion defines a cutout to receive the locking portion for locking the memory module to the card edge connector, the first end defines a groove at a bottom side thereof and communicating with the first cavity, the ejecting portion can extend inwardly into the first cavity from the groove for ejecting the memory module out of the central slot.

11. The card edge connector assembly as claimed in claim 1, wherein the lower portion of the memory module extends continuously from the first side portion to the second side portion and does not have any notch thereon, and the central slot is penetrating from the first end to the second end and does not have any key therein.

12. A card edge connector for mating with a corresponding memory module with a notch at a side thereof, comprising:

an insulative housing having a first end and an opposite second end and a central slot extending from the first end to the second end, the first end having a first cavity for receiving one side of the memory module, the second end having a second cavity for receiving another side of the memory module and a pivot extending into the second cavity to engage with the notch for guiding the memory module being plugged into the central slot along an anticlockwise direction; and a plurality of contacts retained in the insulative housing, each contact having a contact portion extending into the central slot;

wherein the first end has a spring tab with a resistible portion at an upper side thereof to resist the memory module against the pivot.

13. The card edge connector as claimed in claim 12, wherein the first end defines a slit extending therethrough along an up to down direction and communicating with the first cavity along a length direction of the insulative housing, the spring tab extends along the up to down direction, and has a body portion retained in the slit and a board lock extending out of the insulative housing for locking with a circuit board.

14. The card edge connector as claimed in claim 13, wherein the first end has an inner section and an outer section which is narrower than the inner section along a width direction of the insulative housing, the outer section defines a pair of slots at two sides thereof.

15. The card edge connector as claimed in claim 14, further comprising an ejector pivotally assembled to the first end, the ejector has a pair of opposed side walls located at two sides of the outer section, the side walls of the ejector each has a projecting axes engaging with the slots for guiding the ejector moving along a clockwise direction.

16. The card edge connector as claimed in claim 15, wherein the ejector has an ejecting portion at a lower side thereof, and a locking portion extending inwardly from an upper side thereof to lock with the memory module, the first end defines a groove at a bottom side thereof and communicating with the first cavity, the ejecting portion can extend inwardly into the first cavity from the groove for ejecting the memory module out of the central slot.

17. A card edge connector for use with a card, comprising:

an elongated insulative housing defining a central slot extending along a longitudinal direction thereof and opposite first and second longitudinal ends thereof;

a plurality of contacts disposed in the housing by two sides of the central slot;

a first tower formed at the first longitudinal end of the with thereof an arc pivot for supporting a first notch section of the card; and a second tower formed at the second longitudinal end with a resilient deflectable biasing device and a rotatable ejector thereof; wherein said ejector includes an upper locker and a lower kicker for respectively engaging a second notch and a bottom edge of the card, and the deflectable biasing device includes an abutment section for abutting against a side edge of the card under condition that the locker, the abutting section, the pivot and the kicker are respectively at different levels in an insertion direction of the card.

18. The card edge connector as claimed in claim 17, wherein said first notch and the second notch are located at different sides of the card with different dimension or configuration thereof from each other.

* * * * *